US010349732B2

(12) United States Patent
Zou et al.

(10) Patent No.: US 10,349,732 B2
(45) Date of Patent: Jul. 16, 2019

(54) ROTATING COSMETICS BRUSH

(71) Applicant: HOME SKINOVATIONS LTD., Yokneam (IL)

(72) Inventors: Jianhan Zou, Xiamen (CN); LiuAn Yuan, Xiamen (CN); Jiarong Wang, Xiamen (CN); Xuesong Song, Xiamen (CN)

(73) Assignee: Home Skinovations Ltd., Shaar Yokneam, Yokneam (IL)

( * ) Notice: Subject to any disclaimer, the term of this patent is extended or adjusted under 35 U.S.C. 154(b) by 97 days.

(21) Appl. No.: 15/610,831

(22) Filed: Jun. 1, 2017

(65) Prior Publication Data

US 2017/0347789 A1 Dec. 7, 2017

Related U.S. Application Data

(60) Provisional application No. 62/343,913, filed on Jun. 1, 2016.

(51) Int. Cl.

| | |
|---|---|
| ***A46B 9/02*** | (2006.01) |
| ***A45D 19/02*** | (2006.01) |
| ***A45D 34/00*** | (2006.01) |
| ***A45D 40/26*** | (2006.01) |
| ***A46B 13/00*** | (2006.01) |
| ***A46B 13/02*** | (2006.01) |
| ***A46B 13/04*** | (2006.01) |
| ***A46B 11/00*** | (2006.01) |
| ***A45D 33/00*** | (2006.01) |
| ***A45D 33/02*** | (2006.01) |
| ***A45D 34/04*** | (2006.01) |

(52) U.S. Cl.

CPC ..... *A46B 13/04* (2013.01); *A45D 19/02* (2013.01); *A45D 33/00* (2013.01); *A45D 33/02* (2013.01); *A45D 34/042* (2013.01); *A45D 40/262* (2013.01); *A46B 9/021* (2013.01); *A46B 11/001* (2013.01); *A46B 13/008* (2013.01); *A46B 13/02* (2013.01); *A45D 2034/005* (2013.01); *A46B 2200/1046* (2013.01)

(58) Field of Classification Search

CPC ..... A46B 13/001; A46B 13/003; A46B 13/02; A46B 13/04; A46B 13/008; B24B 23/03

See application file for complete search history.

(56) References Cited

U.S. PATENT DOCUMENTS

| | | | | | |
|---|---|---|---|---|---|
| 3,550,324 | A * | 12/1970 | Gerry | B24B 23/03 | 15/49.1 |
| 3,699,952 | A * | 10/1972 | Waters | A46B 13/02 | 15/22.1 |
| 5,385,532 | A * | 1/1995 | Shyu | A46B 13/06 | 15/29 |
| 5,500,972 | A * | 3/1996 | Foster | A46B 13/02 | 15/28 |
| 5,647,841 | A * | 7/1997 | Groenewold | A46B 13/04 | 15/29 |

(Continued)

*Primary Examiner* — David P Angwin
*Assistant Examiner* — Bradley S Oliver

(57) ABSTRACT

A rotating cosmetics brush includes a movable brush head mounted in a housing. A motion actuator is operative to move the brush head in a rotational motion, wherein the brush head rotates about a rotational axis and simultaneously moves in a non-oscillatory movement about another axis different than the rotational axis.

6 Claims, 3 Drawing Sheets

(56) References Cited

U.S. PATENT DOCUMENTS

| | | | | |
|---|---|---|---|---|
| 9,032,576 | B2 * | 5/2015 | Zelickson | A46B 13/02 15/22.1 |
| 9,462,873 | B2 * | 10/2016 | Casasanta, III | A46B 13/04 |
| 9,603,687 | B2 * | 3/2017 | Wu | A61C 17/36 |
| 2016/0287034 | A1 * | 10/2016 | Woodard | A47K 7/046 |
| 2017/0119220 | A1 * | 5/2017 | Nichols | A47K 7/043 |
| 2017/0273514 | A1 * | 9/2017 | Hung | A47K 7/02 |

* cited by examiner

ROTATING COSMETICS BRUSH

FIELD OF THE INVENTION

The present invention relates generally to brushes for applying cosmetics and particularly to a rotating cosmetics brush.

BACKGROUND OF THE INVENTION

Cosmetics refer to a group of substances or mixtures of materials that are applied to portions of a body to alter an appearance, provide a fragrance and/or to protect skin and hair. Cosmetics include, without limitation, skin-care creams, lotions, powders, perfumes, lipsticks, fingernail and toenail polishes, eye and facial makeup, hair colors, hair sprays and gels, deodorants, bath oils, bubble baths, bath salts, butters and many other types of products.

A number of cosmetics, especially those cosmetics referred to as "make-up", are applied using multi-use or single-use brushes, sponges, or pad applicators. A facial cosmetic system often includes a loose applicator that is stored within a cosmetics case (compact) along with a cosmetic. In these facial cosmetic systems, the applicator often becomes coated or soiled with the cosmetic while the compact is carried in a purse, backpack or pocket. Further, these applicators tend to get lost or separated from the compact while being carried around or during use.

Devices exist for applying cosmetics to surfaces. Such devices usually include a handle and an applicator head having a brush or sponge. For example, in the medical industry, applicators are employed for applying medicinal products, such as ointments, to portions of the body. In the cosmetics and personal care industries, applicators are used to apply lipstick, lip balm, skin creams, lotions, and other cosmetic products to portions of the body.

Throughout the specification and claims, the terms "medicinal substance" and "cosmetic" are used interchangeably and the terms encompass cosmetics, drugs and other medicinal products.

SUMMARY OF THE INVENTION

The present invention seeks to provide an improved rotating cosmetics brush, as is described more in detail hereinbelow. The brush of the present invention has a simplified and less expensive construction than prior art devices. The brush or brush head rotates as one unit (i.e., the bristles of the brush head move in unison) and simultaneously travels over a non-circular route without oscillation. In one embodiment, the brush head may move in one rotation direction only (clockwise or counterclockwise). All motions are imparted to the brush by a single motion actuator (e.g., electric motor).

The term "brush" encompasses brushes, pads and sponges and the like.

There is thus provided in accordance with a non-limiting embodiment of the present invention a rotating cosmetics brush including a movable brush head mounted in a housing, and a motion actuator operative to move the brush head in a rotational motion, wherein the brush head rotates about a rotational axis and simultaneously moves in a non-oscillatory movement about another axis different than the rotational axis.

In accordance with a non-limiting embodiment of the invention the non-oscillatory movement is in one direction only which is either clockwise or counterclockwise.

In accordance with a non-limiting embodiment of the invention the motion actuator is operative to rotate a shaft which is linked to the brush head, wherein rotation of the shaft causes rotation of the brush head.

In accordance with a non-limiting embodiment of the invention the rotational axis is a longitudinal axis of the shaft.

In accordance with a non-limiting embodiment of the invention the motion actuator is operative to move an eccentric cam which is arranged to move a guide element, and wherein the shaft is journaled in the guide element so that in addition to the rotation of the shaft, the shaft moves together with the guide element.

In accordance with a non-limiting embodiment of the invention the guide element includes a lug which is arranged to move in a track formed in the housing member.

In accordance with a non-limiting embodiment of the invention the lug is constrained to move along one axis only, but a portion of the guide element that includes the shaft is free to move in more than one axis, such that the lug serves as a moving pivot about which the shaft moves in a non-oscillatory motion.

In accordance with a non-limiting embodiment of the invention a cartridge is provided containing a cosmetic to be dispensed, the cartridge including an applicator probe that extends into the brush head for dispensing the cosmetic out of a distal tip of the probe.

BRIEF DESCRIPTION OF THE DRAWINGS

The present invention will be understood and appreciated more fully from the following detailed description taken in conjunction with the drawings in which.

DETAILED DESCRIPTION OF EMBODIMENTS

Figure 1:
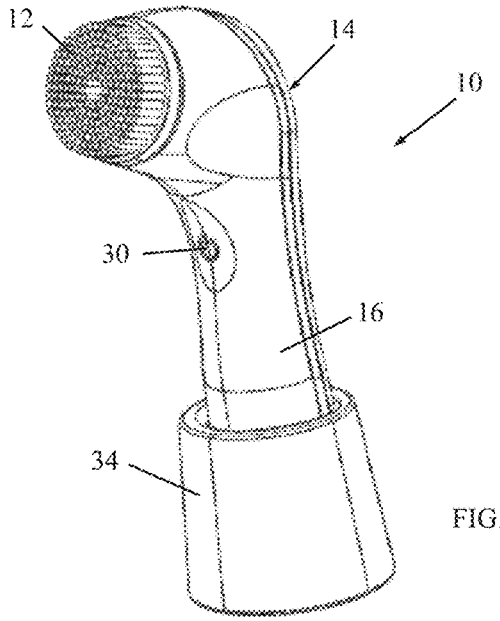
FIGS. 1 and 2 are simplified pictorial and exploded illustrations, respectively, of a rotating cosmetics brush, constructed and operative in accordance with an embodiment of the present invention.
Figure 2:
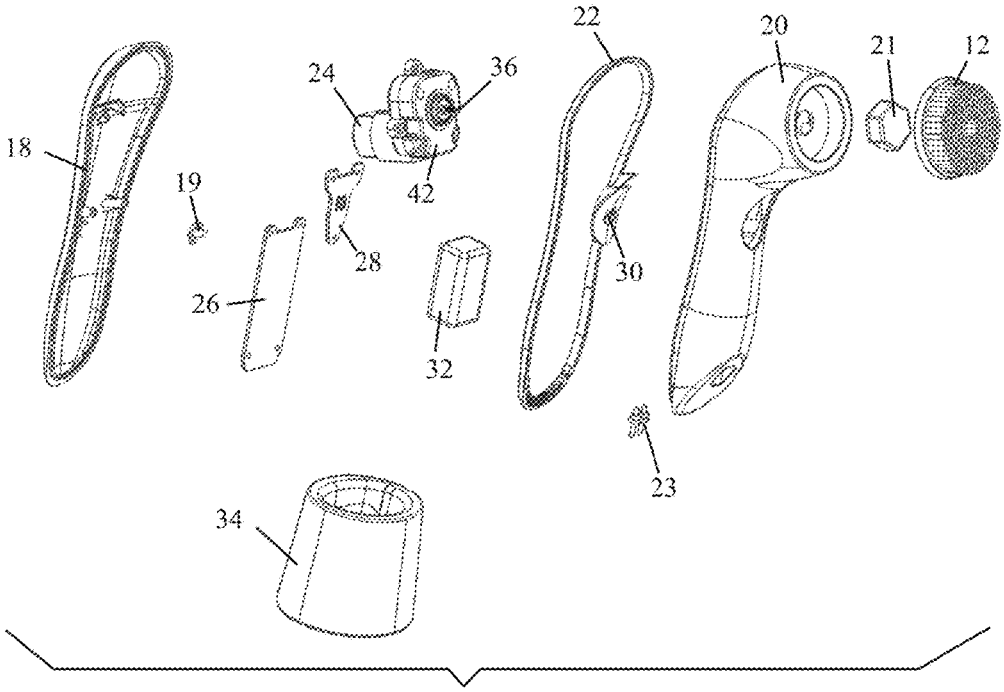

Reference is now made to FIGS. 1 and 2, which illustrate a rotating cosmetics brush 10, constructed and operative in accordance with a non-limiting embodiment of the present invention.

The cosmetics brush 10 includes a movable brush head 12 mounted on a brush head interface 21 in a housing 14. The housing 14 may include a handle 16. The housing 14 may include, without limitation, a back piece 18, a front piece 20 and a seal member 22 that seals the back and front pieces from water entering therein. A light guide 19 may be disposed in housing 14 that directs an indication light indicative of the battery status through back piece 18 (either an opening in the piece or the piece is transparent/translucent). Various fasteners 23 may be used in the housing 14.

A motion actuator 24, such as a motor, electric gear motor or step motor, is mounted in a mounting structure 42 in housing 14. Various printed circuit boards may include control circuitry 26 and switch circuitry 28 for operating the brush 10, and which are in communication with the actuator 24, a rechargeable battery 32 and an operating switch 30. The rechargeable battery 32 may be disposed in housing 14 for providing electrical energy to power the brush 10. The brush 10 may sit in a stand 34, which may be optionally used to recharge the battery 32.

As will be explained below, actuator 24 moves brush head 12 in a rotational motion. The brush head 12 rotates about a rotational axis and simultaneously moves in a non-oscillatory movement about another axis different than the rotational axis.

Figure 3:
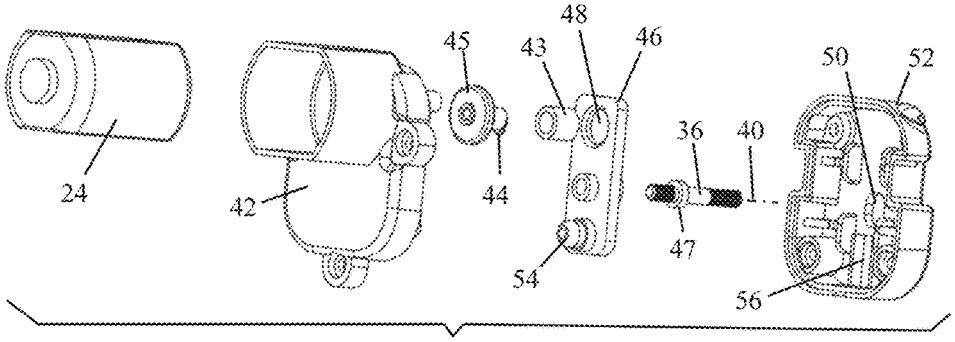
FIG. 3 is a simplified exploded illustration of an actuator and shaft of the cosmetics brush, in accordance with an embodiment of the present invention.

Reference is now made to FIG. 3. The motion actuator 24 is operative to rotate a shaft 36 connected to the brush head 12 (not seen in FIG. 3). For example, without limitation, shaft 36 may include a gear 47 that meshes with a gear in actuator 24. Brush head 12 rotates about a rotational axis 40, which is the longitudinal axis of shaft 36.

The actuator 24 includes or is linked to an eccentric cam 44 (e.g., mounted on a wheel 45) arranged to move a guide element 46. Without limitation, cam 44 rotates in a bushing 43 mounted in a hole 48 formed in guide element 46. As cam 44 rotates, the guide element 46 moves up, down and sideways, in accordance with the movement of the cam 44. The shaft 36 is journaled in guide element 46 and moves together with guide element 46. The shaft 36 protrudes into brush head interface 21 through an aperture 50 formed in a housing member 52.

The guide element 46 include a lug 54 which is arranged to move in a track 56 formed in the housing member 52. Lug 54 is constrained to move in one axis only (up and down in the sense of the drawing), as opposed to the upper part of guide element 46 (including shaft 36) that can move (due to the cam 44) in more than one axis (up, down and sideways, in the sense of the drawing). Thus, lug 54 serves as a moving pivot about which shaft 36 moves in a non-oscillatory motion, such as an oval, elliptic or other motion. This non-oscillatory movement of the shaft 36 and brush head 12 is in one direction only which is either clockwise or counterclockwise. Thus, the motion actuator 24 moves brush head 12 is rotation and simultaneously along another path, without oscillation.

Figure 4A:
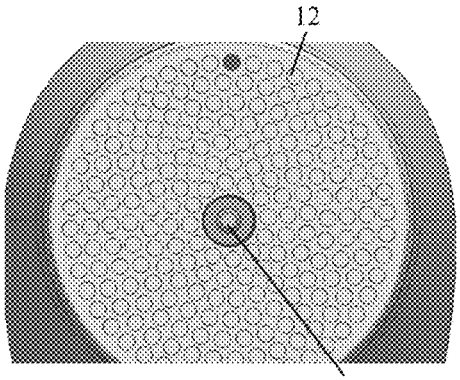
FIGS. 4A-4D are simplified front-view illustrations of a brush head moving in a non-oscillatory movement during use of the cosmetics brush.
Figure 4B:
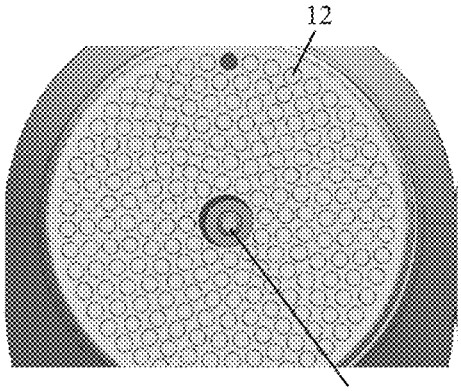
Figure 4C:
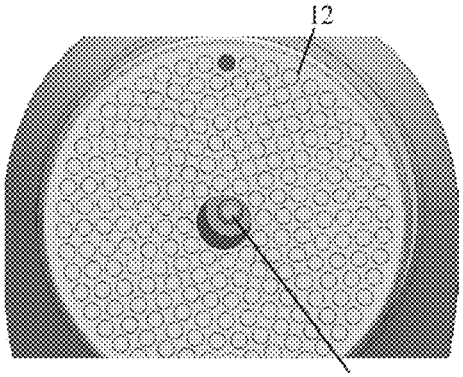
Figure 4D:
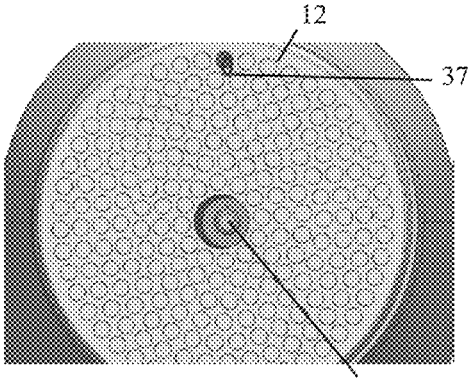

Referring to FIGS. 4A-4D, one can see the brush head 12 traversing an oval path (indicated by the numeral 37 in FIG. 4D). The oval path can be discerned from the different positions of shaft 36 and of the outer perimeter of brush head 12.

The brush 10 may be used to brush a cosmetic substance on a skin surface (or hair or nails, for example). The cosmetic substance may be applied on the skin surface and then spread with brush 10.

Figure 5A:
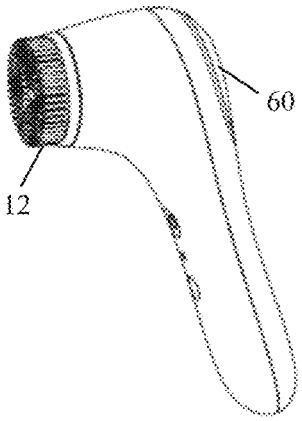
FIGS. 5A and 5B are simplified pictorial and exploded illustrations, respectively, of the brush with a cartridge for dispensing a cosmetic substance, in accordance with a non-limiting embodiment of the invention.
Figure 5B:
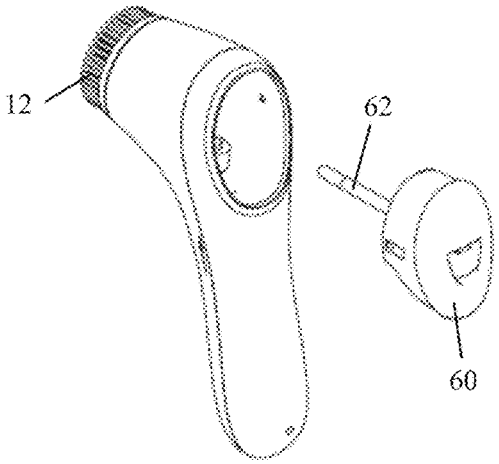

Alternatively, as shown in FIGS. 5A-5B, in accordance with a non-limiting embodiment of the invention, brush 10 may be provided with a cartridge 60 containing a cosmetic to be dispensed. The cartridge 60 may be inserted in an opening at the rear of housing 14 and may include an applicator probe 62 that extends into the brush head 12 for dispensing the cosmetic out of a distal tip of the probe 62. The cosmetic may be drawn to the bristles of the brush head 12 by wicking or capillary action, or may be injected through hollow bristles, or may exit the tip of the probe 62 (positioned in the midst of the bristles) and be deposited on the surface (e.g., skin, hair or nails).

The cosmetic may include, without limitation, a composition for applying to: the nails; the skin; keratinous fibers, in particular the eyelashes, the eyebrows, or the hair; or the lips, e.g. a mascara; an eyeliner; a nail varnish; a lipstick; a lip gloss; a foundation; a blusher; an eye shadow; an eye-contour concealer; an under-eye dark-circle concealer; a self-tanning agent; a sun-screen; a care product for the eyebrows, the eyelids, the lips, the skin of the face, the skin of the cheeks, the nails, the hands, or the feet, a blemish concealer; an anti-wrinkle cream; an under-eye puffiness concealer; a body lotion; a root-treatment composition, in particular for encouraging hair growth, or a massage composition for the face or the body, among others. The composition may contain pigments, fibers, glitter, or other macroscopic elements. The composition may present magnetic properties, where appropriate. The composition may be in powder, paste, gel or liquid form.

The cosmetic may be included in the cartridge. Alternatively, a reservoir may be provided in the brush device for filling and re-filling with the cosmetic.

What is claimed is:

1. A cosmetics brush comprising:

a movable brush head mounted in a housing; and a motion actuator operative to move said brush head in a rotational motion, wherein said brush head rotates about a rotational axis and simultaneously moves in a non-oscillatory movement about another axis different than said rotational axis; wherein said motion actuator is operative to rotate a shaft linked to said brush head, wherein rotation of said shaft causes rotation of said brush head and wherein said motion actuator is operative to move an eccentric cam which is arranged to move a guide element, and wherein said shaft is journaled in said guide element so that in addition to the rotation of said shaft, said shaft moves together with said guide element.

2. The cosmetics brush according to claim 1, wherein the non-oscillatory movement is in one direction only which is either clockwise or counterclockwise.

3. The cosmetics brush according to claim 1, wherein said rotational axis is a longitudinal axis of said shaft.

4. The cosmetics brush according to claim 1, wherein said guide element comprises a lug which is arranged to move in a track formed in said housing member.

5. The cosmetics brush according to claim 1, wherein said lug is constrained to move along one axis only, but a portion of said guide element that includes said shaft is free to move in more than one axis, such that said lug serves as a moving pivot about which said shaft moves in a non-oscillatory motion.

6. The cosmetics brush according to claim 1, further comprising a cartridge containing a cosmetic to be dispensed, said cartridge comprising an applicator probe that extends into said brush head for dispensing the cosmetic out of a distal tip of said probe.

* * * * *